United States Patent [19]

Barton et al.

[11] Patent Number: 5,044,388

[45] Date of Patent: Sep. 3, 1991

[54] PERFORATING GUN PRESSURE BLEED DEVICE

[75] Inventors: John A. Barton, Houston; Thomas D. Ricles, Kingwood, both of Tex.

[73] Assignee: Dresser Industries, Inc., Dallas, Tex.

[21] Appl. No.: 310,243

[22] Filed: Feb. 13, 1989

[51] Int. Cl.[5] ..... E21B 43/112

[52] U.S. Cl. ..... 137/15; 137/318; 166/55; 166/297; 222/83

[58] Field of Search ..... 137/15, 68.1, 68.2, 137/318; 285/197; 222/3, 5, 81, 83, 83.5; 89/1.15; 102/314, 318, 319, 323, 325, 326, 330; 166/55, 55.2, 55.8, 29.7; 175/4.54, 4.56, 4.57, 4.6, 4.51

[56] References Cited

U.S. PATENT DOCUMENTS

| | | | |
|---|---|---|---|
| 1,365,869 | 1/1921 | Temple | 89/1.15 |
| 2,649,273 | 8/1953 | Honegger | 251/122 |
| 3,104,456 | 9/1963 | Powell, Jr. | 137/15 |
| 3,115,889 | 12/1963 | Franck et al. | 137/318 |
| 3,589,453 | 6/1971 | Venghiattis | 175/4.6 |
| 3,833,020 | 9/1974 | Smith | 137/318 |
| 3,863,667 | 2/1975 | Ward | 137/318 |
| 3,868,854 | 3/1975 | Travor et al. | 137/318 |
| 4,083,187 | 4/1978 | Nagashima | 137/68.1 |
| 4,140,188 | 2/1979 | Vann | 175/4.51 |
| 4,355,656 | 10/1982 | Smith | 137/318 |
| 4,399,829 | 8/1983 | Schuler | 102/319 |
| 4,491,185 | 1/1985 | McClure | 175/4.56 |
| 4,537,214 | 8/1985 | Cowan | 137/318 |
| 4,540,011 | 9/1985 | Croxford et al. | 137/318 |
| 4,606,409 | 8/1986 | Peterson et al. | 166/297 |
| 4,609,057 | 9/1986 | Walker et al. | 175/4.6 |
| 4,611,660 | 9/1986 | Stout et al. | 166/297 |
| 4,616,718 | 10/1986 | Gambertoglio | 166/297 |
| 4,649,822 | 3/1987 | Seeman | 89/1.15 |
| 4,694,878 | 9/1987 | Gambertoglio | 166/297 |

FOREIGN PATENT DOCUMENTS

| | | |
|---|---|---|
| 1367148 | 9/1971 | United Kingdom . |
| 2111154 | 6/1983 | United Kingdom . |

*Primary Examiner*—George L. Walton

*Attorney, Agent, or Firm*—Richards, Medlock & Andrews

[57] ABSTRACT

Hydraulic cylinder apparatus, including a ram and attached piercing element is chained and secured around a perforating gun. A hydraulic cylinder is pressurized to thereby drive the piercing element through the sidewall of the perforating gun. The piercing element is tapered so that it is self-sealing during penetration of the gun sidewall. The piercing element is allowed to retract in a controlled manner so as to control the depressurization of the perforating gun.

42 Claims, 4 Drawing Sheets

90
92
68
96
98
100
102
122
124
126
130
132
128
108
110
114
120
112
116
118
70
82
66
60
62
20
80
12
104
106

66
64
68
74
70
76
72
84
82
80
78
62

PERFORATING GUN PRESSURE BLEED DEVICE

TECHNICAL FIELD OF THE INVENTION

The present invention relates in general to perforating guns employed as downhole apparatus in well drilling operations, and more particularly to devices for bleeding the internal pressure of misfired guns in a controlled manner.

BACKGROUND OF THE INVENTION

Downhole firing apparatus is employed to form perforations in well casings and other earth formations so as to provide a flow path for hydrocarbons from the formation into the well casing where it can then be pumped to the surface. Explosive charges are often utilized in perforation guns to form holes in the casings, which can have sidewall thicknesses up to ½ inch. It can thus be appreciated that a substantial amount of energy must be developed as a result of the explosive charge to perforate such a casing sidewall.

When the perforating gun functions properly, the explosive charges therein go "high order", whereby weakened sidewall areas in the perforating gun are blown out by the internal explosive concussion, as are areas of the casing adjacent the perforating gun. However, in certain situations, when the explosive charges within the perforating gun do not go high order, the combustion products do not have an escape path, and thus the pressures within the perforating gun can reach 8,000 psi. A serious problem then arises as to the manner in which the internal gas pressure can be reduced so that the tubing string and perforating gun apparatus can be disassembled at the surface and repaired or replaced. It can be appreciated that with such a pressurized perforating gun, personnel at the surface of the well site are endangered in attempting to disassemble the perforating apparatus.

Another problem is known to exist in which a downhole perforating gun does function properly to perforate the well casing, but thereafter the holes in the gun become plugged, often due to high density drilling mud, or other material. The problem is especially exacerbated in very deep wells where the downhole pressures can approach or exceed 10–15,000 psi. When this occurs, the ambient pressure within the fired perforating gun is at the same pressure as the surrounding bore, and is captured therein by the drill mud. Hence, when the drill string and attached perforating gun are raised to the surface of the earth, the plugged perforating gun is highly pressurized and the situation is much like that of a misfire when the internal explosives do not go high order.

Attempts have been made to address those problems by manually piercing perforating guns at one of the thinned sidewall areas. While such an approach is effective in reducing the internal pressures, the sudden discharge of the pressure is uncontrolled and any internal debris or apparatus is shot from the gun, much like shrapnel. Hence, safety considerations to the personnel still remain a serious problem.

From the foregoing, it can be seen a need exists for apparatus and a technique for depressurizing or bleeding the internal pressures of a perforating gun in a controlled manner so as to reduce the pressure without serious harm to personnel.

SUMMARY OF THE INVENTION

In accordance with the present invention, the disclosed pressure bleed apparatus and method substantially reduce or eliminate the disadvantages and shortcomings associated with prior art techniques. According to the invention, hydraulic cylinder and plunger-ram apparatus is securely chained or strapped to a perforating gun after the misfired gun has been withdrawn to the surface. The end of the hydraulic-driven ram has attached thereto a pointed conical piercing element which is adapted for piercing a scalloped or spotface area or a screw port of the perforating gun. Fixed to the frontal part of the hydraulic cylinder is a gasket or seal which provides a circumferential seal around the area of the scallop to be pierced. Preferably, the hydraulic cylinder is of the double-action type, in which hydraulic fluid can be pumped into one cylinder end thereof to force the ram and attached piercing element outwardly, or to pump hydraulic fluid into the other end and cause the ram and attached piercing element to be withdrawn.

In accordance with the preferred embodiment of the invention, the internal pressure within the perforating gun is bled off in a controlled manner by securing the hydraulic cylinder apparatus to the gun such that the piercing element is adjacent one scalloped area. The elastomer seal fixed to the frontal part of the cylinder is thus squeezed and sealed to the flat scalloped area or the flat surface of a screw port. Then, hydraulic fluid is pumped into the cylinder in such a manner that the tapered end of the piercing element is forced through the scalloped area of the perforating gun. Importantly, the conical shape of the piercing element is self-sealing to the hole formed in the scalloped area, and thus pressure cannot escape until the piercing element is withdrawn. When it is desired to bleed or release the pressure in the perforating gun, the hydraulic fluid is pumped in the other end of the cylinder, thereby retracting the ram and the attached conical element. A fluid path is thereby provided from the pierced hole of the perforating gun through a frontal portion of the cylinder and out a high pressure vent hose. The extent to which the pressure is released from within the perforating gun is determined by the amount by which the conical piercing element is withdrawn from the pierced hole in the perforating gun.

The hydraulic pump which controls the extent by which the ram and attached piercing element is moved, is located remotely so that danger to personnel is substantially lessened. The pressure can thereby be released in a controlled manner, and even stopped, by persons who are not in the area of immediate danger due to the pressurized perforating gun.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts or elements throughout the views, and in which.

DETAILED DESCRIPTION OF THE INVENTION

Figure 1:
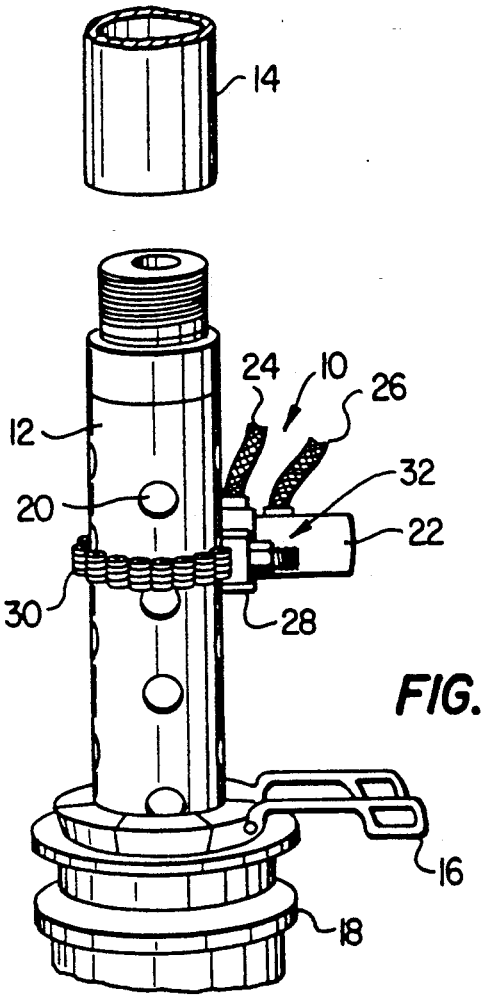
FIG. 1 illustrates a conventional perforating gun to which the pressure bleeding apparatus of the invention is attached.

With reference to FIG. 1, there is illustrated one embodiment of the pressure bleeding device 10, as attached to a perforating gun 12. As can be seen, the perforating gun 12 has been raised to the surface by a drill stem tubular 14, shown removed from the perforating gun 12. A clamp device 16 is employed to grip the perforating gun 12 and prevent it from sliding down the well head or casing, such as shown by numeral 18.

When perforating guns function properly, shaped charges, or other explosive devices, puncture through thinned sidewall areas within the perforating gun 12, such as shown by reference character 20. The thinned areas 20 are commonly termed scalloped or spotface areas. The scalloped areas 20 formed in the sidewalls of the perforating gun 12 have surface areas which are flat. The thickness of the scalloped areas are generally between ⅛ and 3/10 inch thick.

When the drill string 14 is pulled to the surface after a well casing perforating operation, it sometimes occurs that one or more perforating guns in a string fail to go high order, and thus a high pressure can develop within the housing of the gun. Such an indication is apparent when none of the scalloped areas 20 are perforated. Also, and as noted above, when the perforating gun 12 has been properly activated, but the punctured scalloped areas 20 have been plugged, a high pressure can often develop within the gun 12 due to the pressure differences between the surface of the earth and the downhole formation which was perforated. In any event, when it is suspected that a perforating gun 12 is pressurized internally, the present invention can be employed to bleed the pressure from the perforating gun 12 in a controlled manner.

As installed on a perforating gun 12, the pressure bleed device 10, as shown in FIG. 1, includes a hydraulic or pneumatic cylinder 22, of the double-action type, having a pair of hydraulic hoses 24 and 26. The hydraulic cylinder 22 includes a ram and attached conical piercing head (not shown) associated with a mounting bracket 28, adapted for fitting against the exterior sidewall of the perforating gun 12. Attached to the mounting plate 28 are one or more linked chains 30 which are of the heavy duty type. The chain 30 is fastened at each end thereof to the mounting plate 28, and is adjustable by way of a bolt arrangement 32 so that the hydraulic cylinder 22 and associated mounting plate 28 can be tightened securely to the perforating gun 12, adjacent one of the scalloped areas 20.

When installed in the manner noted, the hydraulic hoses 24 or 26 can be coupled at a remote location to a hydraulic pump which is operable to force a hydraulic fluid into one of the hoses 24 and 26 to cause a hydraulic cylinder ram and associated piercing element to puncture the scalloped area 20. When punctured to the degree desired, the hydraulic controls can be reversed, whereupon the ram and associated piercing element are withdrawn only to the extent desired. In this manner, the pressure within the perforating gun 12 can be released in a controlled manner, depending upon the amount by which the hydraulic cylinder ram and piercing head are retracted. Since the personnel operating the pump are not located in the area of the perforating gun 12, the safety to operators is enhanced. After the perforating gun 12 has been completely depressurized, the pressure bleeding device then can be removed and the gun 12 can be removed from the casing head 18 and safely disassembled and repaired for reuse.

Figure 2:
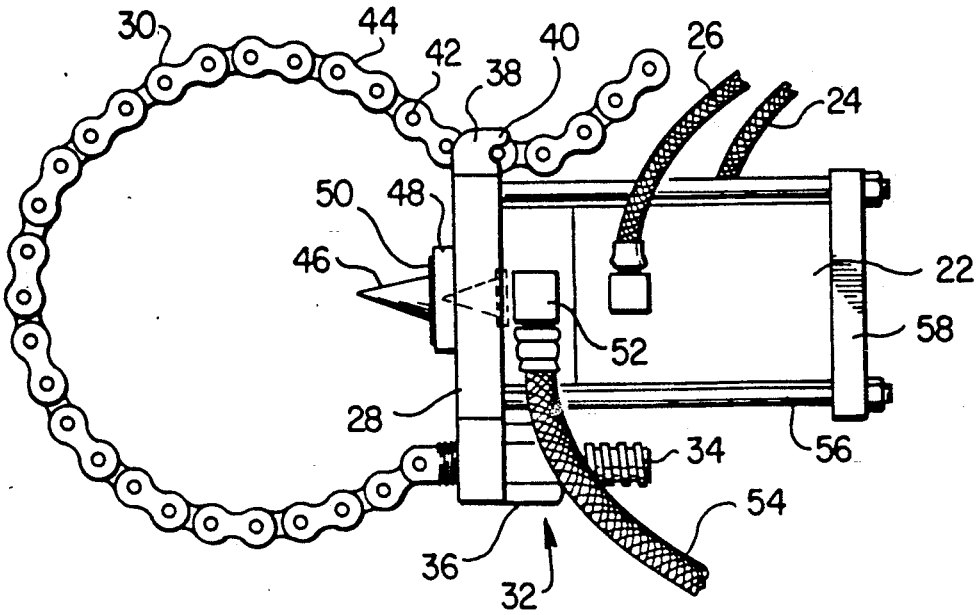
FIG. 2 is a top view of one embodiment of the perforating gun pressure bleeding apparatus of the invention.

FIG. 2 illustrates a perforating gun pressure bleed device which is similar to that depicted above in connection with FIG. 1. Like the device 10 described above, the device of FIG. 2 includes a heavy duty linked chain 30 which is attached to the mounting plate 28 by the nut and bolt threaded arrangement 32. One end link of the chain 30 is fastened to a threaded rod 34 which passes through a hole in the mounting plate 28. A nut 36 can be threaded down onto the threaded rod 34 sufficiently to tighten the chain 30 around the perforating gun 12. Attached at an opposite side of the mounting plate 28 is a saddle arrangement 38 which includes two or more ears 40 for engaging the pins 42 which extend beyond the sides of the links 44 of the chain 30. With such a construction, the chain 30 can encircle perforating guns of widely different diameters, and the general slack taken up by the proper engagement of a pin 42 within the saddle 38. The nut 36 can then be rotated to tightly secure the pressure bleed device to the perforating gun 12.

The conical piercing element 46 is shown in solid line fully extended, and is shown in broken line fully retracted. Attached to the frontal part of the mounting plate 28 is a raised area, or a boss 48. On the face of the boss 48 is adhered, or otherwise fixed, a gasket or O-ring 50 for providing a seal with the flat surface of a scalloped area 20 on the perforating gun 12. As can be appreciated, the pressure bleed device is installed on the perforating gun 12 with the hydraulic cylinder ram and attached piercing element 46 completely withdrawn. By tightening the bleed device to the perforating gun 12 with the nut and bolt threaded arrangement 32, a high pressure seal is achieved between the flat surface of the scalloped area 20 and pressure bleed device. The hydraulic cylinder 22 can then be pressurized so that the piercing element 46 punctures the scalloped area 20. As noted above, because of the conical nature of the piercing element 46, no pressure is relieved from the perforating gun 12 during the time the piercing element 48 is puncturing the scalloped area 20. In this regard, the piercing element 46 is self-sealing, until it is retracted by reversing the direction of the hydraulic cylinder ram. While not specifically shown in FIG. 2, perforating gun pressure can be released through a channel between the ram and a central bore through the boss 48, and through a channeled area in the mounting plate 28. The explosive by-products and other material which are pressurized within the perforating gun 12 can then exit the bleed device through hose connection 52 and a high pressure hose 54. The hose 54 should preferably be of the high pressure type suitable for withstanding the pressures which can build up within a misfired perforating gun 12. In order to achieve a high pressure seal between the hydraulic cylinder 22 and the mounting plate 28, multiple anchor bolts, such as 56, hold the hydraulic cylinder 22 in compression between the mounting plate 28 and end plate 58.

Figure 3:
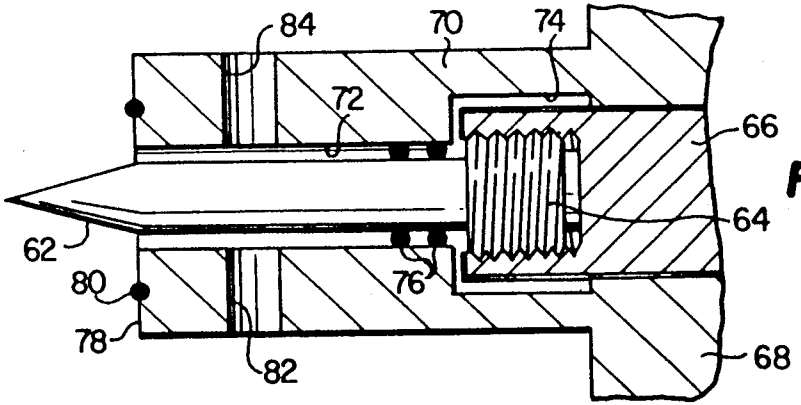
FIG. 3 illustrates a sectional view of the invention, illustrating the fluid path of the bleeding apparatus for routing the pressurized fluid from the perforating gun.

FIG. 3 illustrates a piercing element 60, constructed in accordance with the preferred embodiment of the invention. The piercing element 60 has a conical, or tapered end 62, tapered with an angle of about 30°. The piercing element 60 is constructed of a heat treated stainless steel material to resist corrosion, and machined at its frontal end thereof to form the taper 62 such that punctures of at least 0.43–0.50 inch diameter can be made in the scalloped areas 20. Machined at the back part of the piercing element 60 are threads 64 which mate with corresponding internal threads formed within the ram 66 of the hydraulic cylinder. Because of the pressures involved in piercing the scalloped areas 20, the piercing element 60 bottoms out in the threaded opening of the ram 66 so as to remove the load from the threads.

A cap 68 which is threadably engaged with the hydraulic cylinder case includes a sleeve 70 having a smaller diameter bore 72 through which the piercing element 60 moves, and a larger diameter bore 74 for slidably receiving the ram 66. The bore 72 includes a pair of annular grooves for holding a corresponding pair of O-rings 76 to prevent pressurized vapors and explosive by-products of the gun from entering the hydraulic cylinder. Also formed in the face 78 of the sleeve 70 is another annular recess for receiving a larger O-ring 80 which effects a seal to the flat scalloped area 20 of the perforating gun 12. In order to release the pressurized explosion by-products within the perforating gun 12, a pair of ports 82 and 84 are formed in the sleeve 70.

In operation of the piercing element 60 shown in FIG. 3, the hydraulic cylinder is pressurized to force the ram 66 and the attached piercing element 60 outwardly, to the left of the drawing, which is shown in a fully extended position. The tapered end 62 of the piercing element 60 pierces the scalloped area 20 and, at the same time, maintains a seal. The ram and piercing element 60 are retracted a desired amount to form an orifice between the pierced hole in the scalloped area 20 and the tapered surface 62 to thereby control the pressure released from the perforating gun 12. The pressurized explosion by-products are channeled through a frontal portion of the sleeve bore 72 and out the ports 82 and 84 to the atmosphere.

Figure 4:
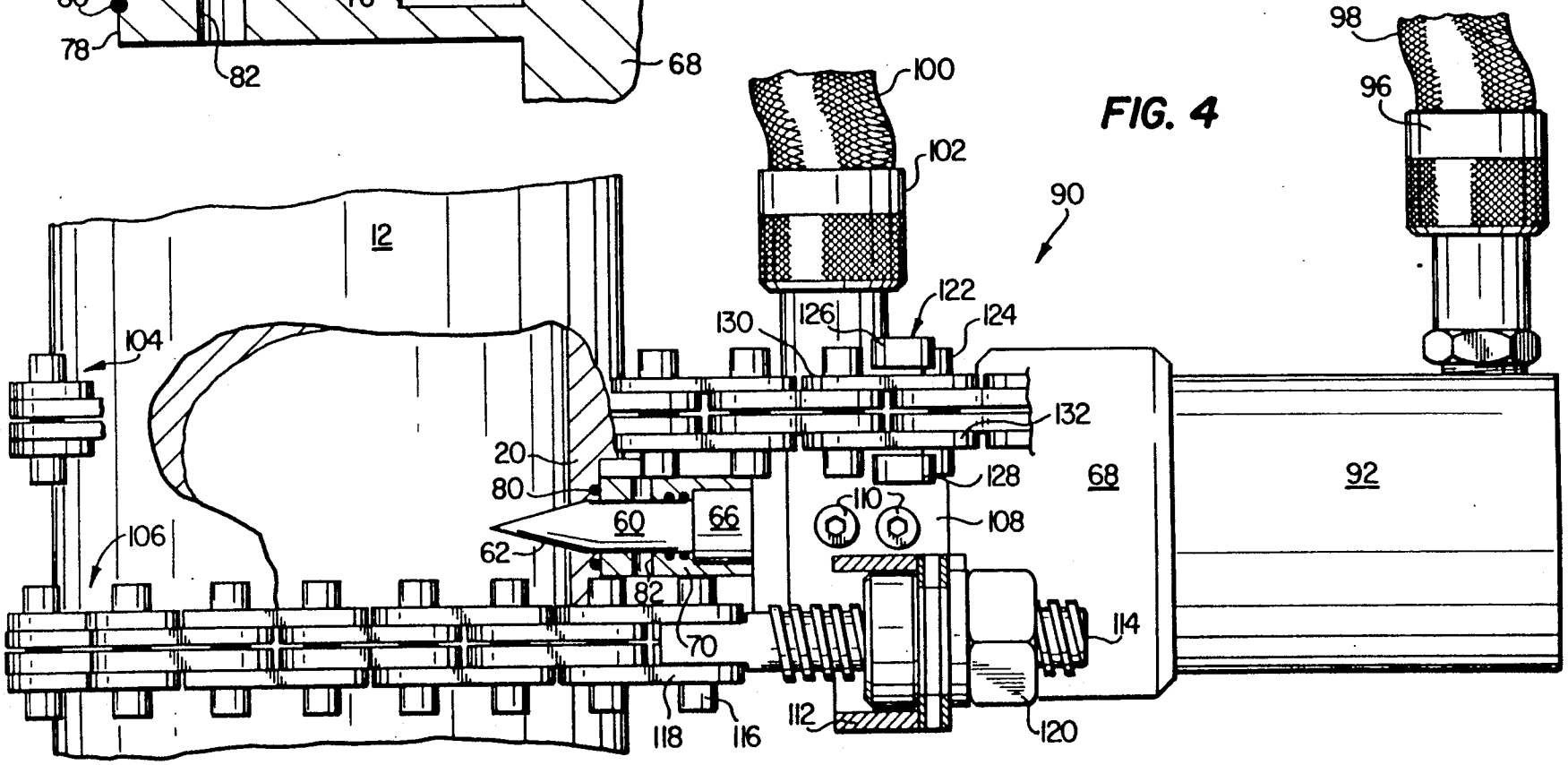
FIG. 4 illustrates the detailed construction of the pressure bleeding apparatus according to the preferred embodiment of the invention.

FIG. 4 depicts the details of the pressure bleed device in which the piercing element 60 of FIG. 3 is employed. The piercing apparatus 90 comprising a double action hydraulic cylinder 92 to which a cylindrical cap 68 is threadably fixed thereto. The hydraulic cylinder 92 is of conventional design adapted to apply a pressure sufficient to cause the piercing element 60 to puncture the scalloped area 20 of the perforating gun 12. Preferably, the travel or stroke of the ram 66 need only be about one inch. Pressurized hydraulic fluid can be pumped through hose 98 into a first quick-connect hose connection 96 to force the hydraulic ram 66 and the attached piercing element 60 outwardly. Alternatively, hydraulic fluid can be pumped via high pressure hose 100, terminated by a similar quick-connect connector 102, to force the ram 66 and the piercing element 60 in a retracted position. Importantly, the extent to which the hydraulic fluid is pumped through hose 98 or 100 can be regulated to pierce the scalloped area 20 to a desired degree and thus form a hole of predefined diameter. Also, the travel of the piercing element 60 can be regulated so that it can be withdrawn a certain distance and thereby form an orifice therearound for regulating the rate at which the perforating gun 12 is depressurized As noted, the screw-on cap 68 has formed on its frontal end the sleeve 70 which abuts within the recessed area of the perforating gun scalloped area 20, and is sealed thereto by the O-ring 80. The seal between the sleeve 70 and the perforating gun 12 is maintained by a pair of linked chains 104 and 106 which are wrapped around the perforating gun 12 and clamped to the hydraulic cylinder cap 68. The chains 104 and 106 are each adjustable to accommodate perforating guns of diverse diameters Preferably, perforating guns from 1 9/16 inch through 7¼ inch outside diameters are easily accommodated by chains 104 and 106 of suitable length.

Figure 5:
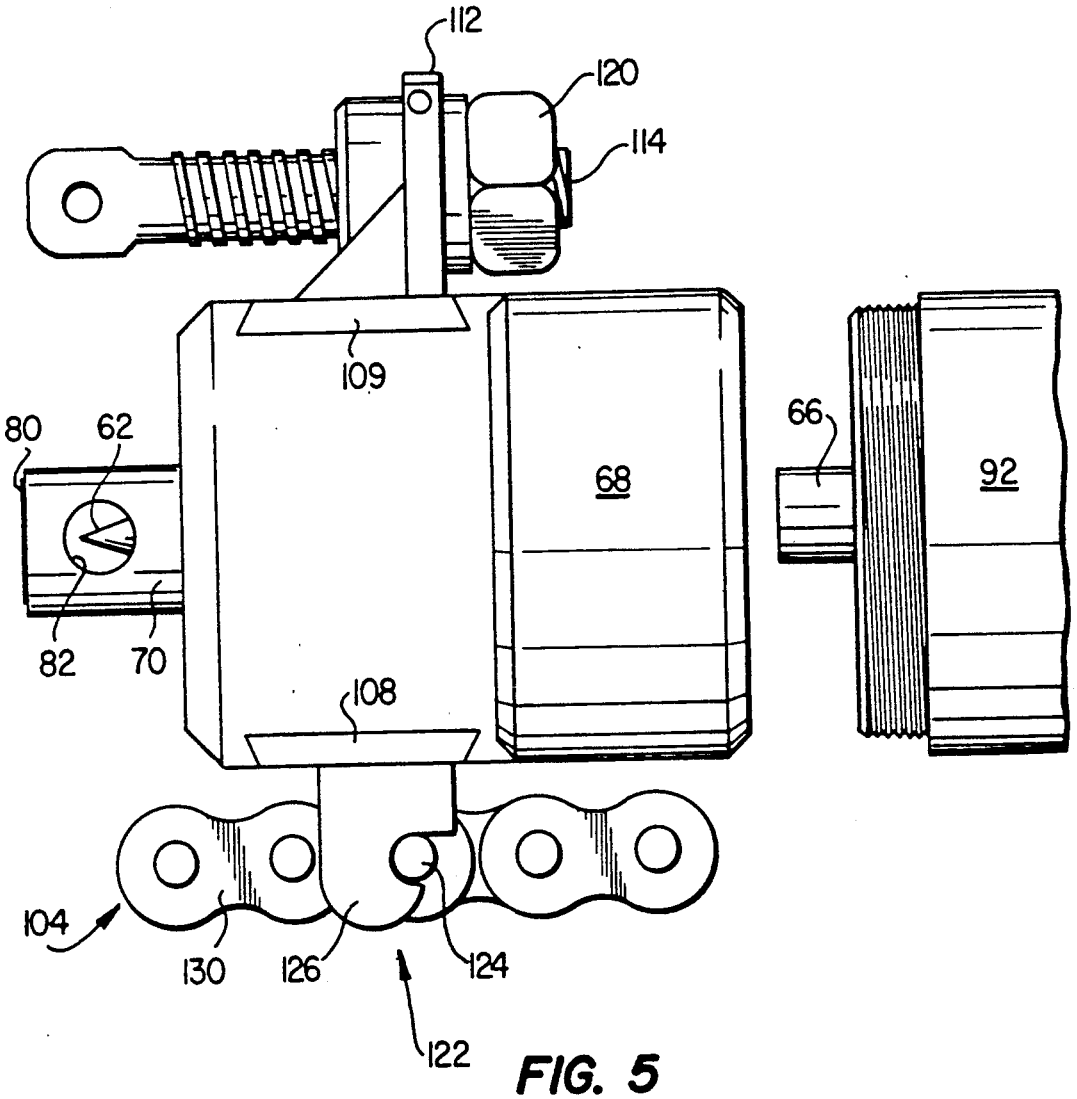
FIG. 5 illustrates the details of the apparatus for anchoring clamp chains to the hydraulic cylinder.

The ends of each linked chain 104 and 106 are fixed to corresponding brackets 108 and 109 which are fastened on opposing sides of the cap 68 by bolts 110. FIGS. 4 and 5 illustrate the apparatus for anchoring the chains 104 and 106 around the perforating gun 12. The screw-on cap 68 has a flattened, dove-tailed area formed on opposing sides thereof for accommodating the brackets 108 and 109. The brackets 108 and 109 are formed in substantially identical manners. The brackets 108 and 109 shown are heavy-duty to withstand the pressures exerted between the perforating gun 12 and the piercing element 60. Formed at one end of each bracket is a channel piece 112 having a hole therein through which a threaded end of link piece 114 passes. The other end of the threaded link piece 114 is pinned with a pin 116 to link parts 118, and thus to the remaining portion of the chain 106. A nut 120, when tightened, is effective to securely clamp the hydraulic cylinder 92 adjacent a scalloped part 20 of the perforating gun 12. The other linked chain 104 is terminated in a similar arrangement on the other side of the screw-on cap 68.

With regard to the top link chain 104, there is shown a saddle 122 for capturing any one of the pins 124. The saddle 122 essentially includes a portion of the heavy-duty bracket 108 which has spaced apart members 126 and 128 of spacing sufficient to accommodate the width of the chain link elements 130 and 132. However, the pins 124 which extend beyond the linked pieces 130 and 132 are captured by the saddle arms 126 and 128 and thereby secured. With such a construction, the chain 104 can be adjusted around any diameter perforating gun 12 sufficiently to lodge a pin in the recessed area of the saddle 122, an adjust any remaining slack with the nut 120. Associated with chain 106 is a corresponding saddle arrangement on the side of the screw-on cap 68 not shown. The chains 104 and 106 are of the type typically used as pipe vices, and of such a construction as to withstand the pressures experienced in piercing perforating gun scalloped areas.

When the pressure bleed device 90 is attached to a perforating gun 12 in the manner noted, hydraulic pressure can be pumped through high pressure hose 98 to force the piercing element 60 through the scalloped area 80. During the piercing step, the tapered end 62 of the piercing element 60 maintains a fluid tight connection with respect to the scalloped area 20, thus preventing release of the internal pressure. When it is desired to release the pressure within the perforating gun 12, either the pressure in the hydraulic hose 98 can be released, or hydraulic fluid can be pumped into hose 100 to a certain degree to retract the piercing element 60. The combustion products within the perforating gun 12 can then exit through ports 82 and 84 to the atmosphere. If it is desired to reseal the perforating gun 12, hydraulic fluid can simply be pumped back through high pressure hose 98 to force the piercing element 60 back into sealing engagement with the pierced scalloped area 20. While the invention is described in terms of perforating guns having scalloped areas, the controlled pressure bleed device can be employed with other types of perforating guns having special replaceable threaded plugs which can be pierced by the element 60. Also, the piercing element 60 can be constructed of a different material than that noted above in order to successfully pierce strong or thick materials.

Figure 6:
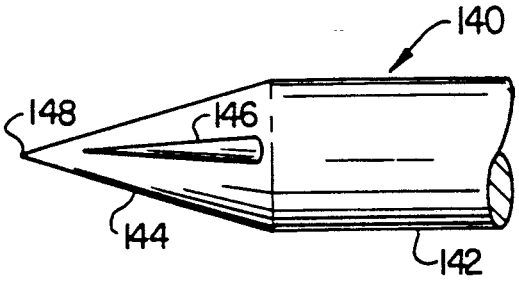
FIG. 6 illustrates a fluted piercing element which provides controlled release of pressure from a pierced perforating gun.

FIG. 6 illustrates another embodiment of a piercing element 140 adapted for alternative use with the pressure bleed apparatus of the invention. The piercing element 140 includes a shaft 142 with a tapered end 144. The tapered surface 144 is fluted with a number of grooves 146 so that during the piercing operation, pressurized combustion products within the perforating gun 12 are released. As can be seen, the grooves 146 are formed so as to be wider and deeper near the larger diameter portion of the tapered end of the piercing element 140. In this manner, as the piercing element 140 is forced further through the scalloped sidewall area 20, the grooves 146 are larger, and thus the internal pressure within the perforating gun 12 is released to a greater extent. As noted, the grooves 146 do not extend to the tip 148 of the piercing element 140, and thus a seal remains to the scalloped area 20 until the piercing element 140 passes therethrough sufficiently that the forward end of the grooves 146 emerge entirely through the sidewall of the scalloped area 20. Preferably, three or four grooves are formed equidistantly around the tapered surface 144 of the piercing element 140.

Figure 7:
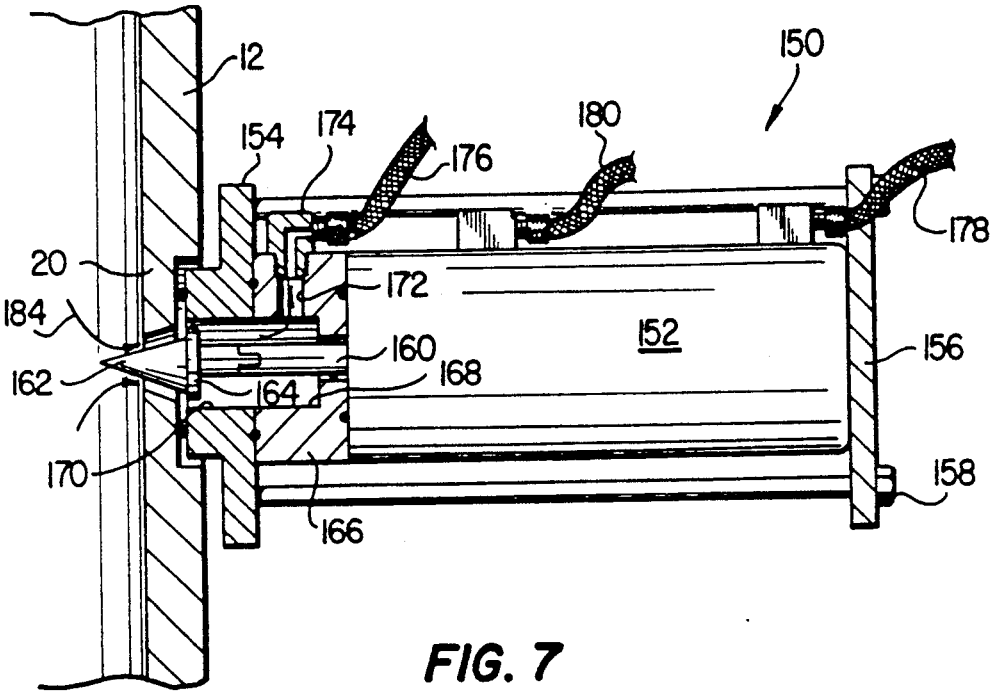
FIG. 7 depicts another embodiment of the invention in which the discharge of pressure from a perforating gun can be remotely vented.
Figure 8:
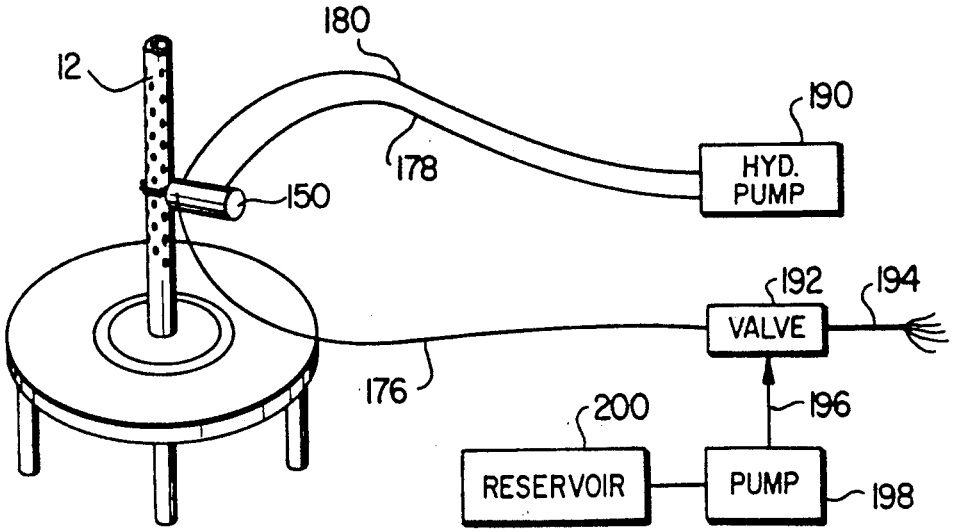
FIG. 8 diagrammatically illustrates a hydraulic system for controlling the perforating gun piercing apparatus and for channeling the pressurized fluid therefrom in a controlled manner.

FIG. 7 illustrates another embodiment of the pressure bleed device of the invention. The chains and the associated clamping apparatus are not shown in the embodiment of FIG. 6. The device 150 includes a hydraulic cylinder 152 which is clamped between a frontal plate 154 and a back plate 156 by a number of bolts, such as 158. Threadably connected to a ram 160 of the hydraulic cylinder 152 is a piercing element 162. In this embodiment, the piercing element includes an annular shoulder 164 encircling the larger diameter portion of the tapered point. The annular shoulder 164 limits the extent of piercing of the element 160 through the scalloped area 120 of the perforating gun 12.

Clamped between the frontal plate 154 and the hydraulic cylinder 152 is an intermediate plate 166 which has a chamber 168 formed around the ram 160, and formed collinear with a bore 170 in the frontal plate 154. The intermediate plate 166 has formed therein a passage 172 in which is threadably connected a hydraulic connection 174. A hydraulic vent hose 176 is connected to the hydraulic connection 174, and provides an external channel to the chamber 168. A number of O-rings are effective to provide a seal between the various parts of the pressure bleed device 150.

When hydraulic fluid is initially pumped through high pressure hose 178 the piercing element 162 rams a hole in the scalloped area 20. When the pressure in hose 178 is released, or when hydraulic fluid is pumped into hose 180, the piercing element 162 is withdrawn to a certain extent. The combustion by-products can thus be released through the orifice around the piercing element 162, into the chamber 168 and out the high pressure vent hose 176. The path of the pressurized combustion by-products is shown by arrows 184.

FIG. B diagrammatically illustrates a hydraulic system which can be employed in conjunction with the embodiment depicted in FIG. 6, or with various other embodiments disclosed herein. The high pressure hoses 178 and 180 connected to the hydraulic cylinder part of the device 150 are remotely connected to a hydraulic pump 190. The hydraulic pump 190 can be hand operated, and include a gauge, so that the pressure within the hydraulic lines 178 nd 180 can be monitored during piercing of the scalloped area 20, or during retraction of the piercing element 162. The pump 190 is preferably the type which can be switched to pump hydraulic fluid into either hose 178 or 180. Included within the hydraulic pump 190 is a reservoir (not shown) for providing a closed hydraulic system for the hydraulic fluid.

Vent line 176 is connected to a valve 192 which is switchable between at least two positions. In one position, valve 192 allows combustion by-products to be directed through outlet 194 and discharged into a contained vessel, or to the atmosphere. When valve 192 is switched to a second position, the vent line 176 is connected to a line 196 to another fluid pump 198. The fluid pump 198 is connected to a reservoir 200 containing a desired type of liquid. With this arrangement, liquids contained within the reservoir 200 can be pumped through the valve 192, via the pump 198, through the vent line 176 and into the perforating gun 12. Preferably, such liquids would be adapted for dissolving the explosive material within the perforating gun. The valve 192 can also have a third position which would close exit of the pressure through outlet 194, until opened, in which event the pressure could be further regulated at the remote location by the valve 192.

From the foregoing, disclosed is a pressure bleed device for releasing pressure within a perforating gun in a controlled manner. The device can be secured to a perforating gun and pressured from a remote location so that a piercing element penetrates the perforating gun. Importantly, the piercing element remains sealed to the perforating gun as penetration is made therethrough. Only on a controlled retraction of the piercing element are the combustion products released from the perforating gun. The combustion products can be released into the atmosphere or through other valve and pump apparatus.

While the preferred and other embodiments of the invention have been disclosed with reference to specific pressure bleed devices, and methods, it is to be understood that many changes in detail may be made as a matter engineering choices without departing from the spirit and scope of the invention, as defined the appended claims.

What is claimed is:

1. Apparatus for piercing a perforating gun to release trapped pressure therefrom, said perforating gun including downhole equipment for perforating well casings, in the event that said perforating gun when disposed double fails to perforate the well casing, said perforating gun is brought back to the surface to release the trapped pressure therein by said apparatus to prevent serious injury, said apparatus comprising:

a ram-operated cylinder for attachment to the perforating gun;

a sleeve structure disposed between the cylinder and the perforating gun, said sleeve having a port for venting fluid pressure within the gun to a location external to said piercing apparatus;

a piercing element located at an end of a ram of said cylinder, and movable in said sleeve structure for piercing said perforating gun without severing said perforating gun, said piercing element being shaped so that during piercing, the piercing element maintains the pressure sealed within the gun, and when the piercing element is retracted, the pressure within the gun is vented through the port in said sleeve;

means for operating said cylinder so that said ram is extended and said piercing element pierces the perforating gun; and means for retracting said piercing element in a controlled manner so that pressure within said perforating gun is released in a corresponding controlled manner.

2. The apparatus of claim 1, wherein said piercing element includes an annular tapered end movable partially into a sidewall of the perforating gun to form a corresponding tapered hole in the perforating gun sidewall, the tapered piercing element and the tapered hole sealing the gun pressure until the piercing element is retracted.

3. The apparatus of claim 1, wherein said piercing element includes a tapered end having axial grooves therein.

4. The apparatus of claim 1, wherein said piercing element includes a tapered end which terminates in a shouldered part to limit the extent to which said piercing element can penetrate the perforating gun.

5. The apparatus of claim 1, further including a linked chain for affixing said apparatus to the perforating gun.

6. The apparatus of claim 1, further including seal means for sealing said sleeve structure to a flat sidewall section of the perforating gun so that discharge of pressure is accomplished between the seal means and the piercing element.

7. The apparatus of claim 6, further including an O-ring seal between t he perforating gun and said apparatus.

8. The apparatus of claim 6, further including a sealed channel between the perforating gun and an internal chamber of the apparatus.

9. The apparatus of claim 8, further including a vent line connected to the internal chamber for discharging pressure at a remote location.

10. The apparatus of claim 9, further including a valve connected to said vent line.

11. The apparatus of claim 10, further including a pump attached to the valve for pumping a fluid to the perforating gun.

12. The apparatus of claim 1, wherein said cylinder comprising a double action cylinder which can be operated in a first direction to cause the perforating gun to be pierced, and in a second direction for withdrawing the piercing element in a controlled manner.

13. The apparatus of claim 1, further including a pair of linked chains attachable around the perforating gun, and adjustably mounted to the cylinder for securing the apparatus to the perforating gun.

14. The apparatus of claim 1, further including a frontal portion of said piercing apparatus being adapted for sealing to a flat scalloped area of the perforating gun.

15. Apparatus for piercing a perforating gun to release trapped pressure therefrom, said perforating gun including downhole equipment for perforating well casings, in the event that said perforating gun when disposed downhole fails to perforate the well casing, said perforating gun is brought back to the surface to release the trapped pressure therein by said apparatus to prevent serious injury, said apparatus comprising:

a cylinder pressurizable to operate a ram;

a pointed element mounted to an end of a said ram for piercing a sidewall of the perforating gun so that pressure can be released therefrom;

stop means for limiting the movement of the ram after the pointed element has pierced the perforating gun sidewall;

a seal boss affixed to a frontal part of said cylinder, said seal boss having a bore through which said piercing element is movable by said ram, and including a seal for sealing the seal boss to the perforating gun;

a clamp attachable around the perforating gun and to said cylinder for attaching said apparatus to the gun; and means for adjusting said clamp for securing the apparatus tightly to the perforating gun.

16. The apparatus of claim 15, wherein said clamp comprises a pair of linked chains.

17. The apparatus of claim 16, wherein said clamp further includes a saddle element for capturing pins of said chains for fixing one end of each chain to the cylinder.

18. The apparatus of claim 16, further including an anchor screw adjustment at an end of each said chain for tightening the apparatus to the perforating gun.

19. The apparatus of claim 15, further including an internal chamber in said apparatus through which said ram operates, and a port in said chamber for allowing discharge of pressure from the perforating gun.

20. The apparatus of claim 15, further including a hydraulic pump remotely located from said perforating gun, and a hydraulic hose connecting said pump to said cylinder.

21. The apparatus of claim 20, wherein said pump is hand-operated for controlling return of hydraulic fluid from said cylinder to thereby control retraction of said piercing element.

22. Apparatus for piercing a perforating gun to release internal pressure therefrom, said perforating gun being cylindrical shaped and of the type having flat scalloped areas which are plugged until pierced to allow discharge of the internal gun pressure, said perforating gun including downhole equipment for perforating well casings, in the event that said perforating gun when disposed downhole fails to perforate the well casing, said perforating gun is brought back to the surface to release the internal pressure therein by said apparatus to prevent serious injury, said apparatus comprising:

a double action hydraulic cylinder having a ram which can be forced in a first direction for causing said perforating gun to be pierced, and in a second direction for releasing pressure from the perforating gun;

a piercing element having a tapered surface attached to an end of said ram;

means for limiting the piercing movement of the element into the sidewall of the gun such that said tapered surface can remain sealingly engaged with a pierced hole in said sidewall;

a cap threadably secured to a frontal end of said cylinder, said cap having a sleeve and an elastomer seal for sealing said sleeve to a flat scalloped area of the perforating gun, the sleeve having an internal chamber ported to the exterior thereof, and including O-ring seals for sealing a shaft portion of said piercing element to said sleeve;

a pair of linked chains; and a pair of brackets mounted on opposing sides of said cap for adjustably anchoring ends of said pair of linked chains thereto.

23. The apparatus of claim 22, wherein each said bracket includes a hole for receiving therein a threaded portion of one said chain, and a saddle member for capturing a pin of the other said chain.

24. The apparatus of claim 22, further including a passage from a pierced portion of a scalloped area of the perforating gun through the ported chamber to the exterior of said apparatus.

25. The apparatus of claim 22, further including, in combination, a hydraulic pump connected by high pressure hoses to said double action cylinder for controlling hydraulic fluid directed to the hydraulic cylinder, and for controlling hydraulic fluid returning from said cylinder.

26. A method for releasing internal pressure from a perforating gun utilizing a piercing apparatus, said perforating gun including downhole equipment for perforating well casings, in the event that said perforating gun when disposed downhole fails to perforate the well casing, said perforating gun is brought back to the surface to release the trapped pressure therein by said apparatus to prevent serious injury, said method comprising the steps of:

piercing the perforating gun in such a manner as to maintain a seal between a piercing element and the perforating gun;

withdrawing the piercing element in a controlled manner so as to control the depressurization of the perforating gun in a corresponding manner; and venting the pressure from the gun and external to the piercing apparatus.

27. The method of claim 26, further including piercing the perforating gun with a tapered element which forms a round hole having a tapered seat which is self sealing to the tapered piercing element.

28. The method of claim 26, further including withdrawing the piercing element so as to form an orifice therearound for discharge of the pressure therethrough at a predefined rate.

29. The method of claim 28, further including controlling the orifice size in a manner proportional to the extent by which the piercing element is retracted.

30. The method of claim 26, further including interrupting depressurization of the perforating gun by extending the piercing element into the perforating gun.

31. A method for controlling the release of internal pressure from a perforating gun utilizing a piercing apparatus, said perforating gun including downhole equipment for perforating well casings, in the event that said perforating gun when disposed downhole fails to perforate the well casing, said perforating gun is brought back to the surface to release the internal pressure therein by said apparatus to prevent serious injury, said method comprising the steps of:

fixing the piercing apparatus to a perforating gun;

sealing the perforating gun to the end of the piercing apparatus but butting an end of the piercing apparatus to the sidewall to be pierced prior to a piercing operation without circumferentially sealing around said perforating gun; and piercing the perforating gun by moving a piercing element through the sealed sidewall area of the perforating gun and allowing pressurized fluid within said perforating gun to be discharged.

32. The method of claim 31, further including sealing a flat area of said perforating gun intermediate opposing ends of the gun to a hollow sleeve part of said cylinder to define a sealed chamber.

33. The method of claim 32, further including extending a piercing element through said chamber for piercing said perforating gun.

34. The method of claim 33, further including discharging pressurized fluid from the perforating gun through ports in said sleeve part.

35. The method of claim 33, further including discharging pressurized fluid from the perforating gun through a port in a sidewall of said sleeve part, and through a high pressure vent hose.

36. The method of claim 35, further including connecting a valve at the end of the high pressure vent hose to control the discharge of pressurized fluid.

37. The method of claim 35, further including deactivating explosive material contained within the perforating gun after discharge of pressurized fluid by pumping a fluid through said vent hose into said perforating gun to dissolve the explosive material.

38. The method of claim 31, further including operating said cylinder from a remote location.

39. A method for releasing internal pressure from a perforating gun utilizing a piercing element, said perforating gun including downhole equipment for perforating well casings, in the event that said perforating gun when disposed downhole fails to perforate the well casing, said perforating gun is brought back to the surface to release the trapped pressure therein by said apparatus to prevent serious injury, said method comprising the steps of:

clamping a pressure-operated cylinder to a perforating gun by wrapping a linked chain around the gun and fastening the linked chain to the cylinder;

tightening said linked chain so that an elastomer-faced portion of said cylinder is sealed to the perforating gun;

pressurizing the cylinder with a fluid so that a ram of said cylinder forces the piercing element through a sidewall portion of the perforating gun;

releasing fluid from said cylinder so that said piercing element is withdrawn from an aperture formed in said perforating gun sidewall; and venting pressurized fluid from said perforating gun through said sealed cylinder.

40. The method of claim 39, further including venting the pressurized fluid in a controlled manner.

41. The method of claim 40, further including venting the pressurized fluid by an amount corresponding to the extent by which said piercing element is withdrawn.

42. The method of claim 39, further including piercing the perforating gun with an annular tapered piercing element.

* * * * *

UNITED STATES PATENT AND TRADEMARK OFFICE

CERTIFICATE OF CORRECTION

PATENT NO. : 5,044,388

DATED : September 3, 1991

INVENTOR(S) : Barton et al.

It is certified that error appears in the above-identified patent and that said Letters Patent is hereby corrected as shown below:

Col. 8, line 9, change "B" to --8--.

Col. 8, line 67, change "double" to "downhole".

Col. 11, line 53, after "an", insert --annular--.

Signed and Sealed this

Fifteenth Day of February, 1994

*Attest:*

Bruce Lehman

BRUCE LEHMAN

*Attesting Officer*

*Commissioner of Patents and Trademarks*